US010862221B2

(12) United States Patent
Yman et al.

(10) Patent No.: US 10,862,221 B2
(45) Date of Patent: Dec. 8, 2020

(54) ANTENNA FEEDING NETWORK COMPRISING AT LEAST ONE HOLDING ELEMENT

(71) Applicant: CELLMAX TECHNOLOGIES AB, Kista (SE)

(72) Inventors: Niclas J. Yman, Ekerö (SE); Stefan Jonsson, Sollentuna (SE); Dan Karlsson, Sollentuna (SE); Andreas Nordström, Sollentuna (SE)

(73) Assignee: CELLMAX TECHNOLOGIES AB, Kista (SE)

( * ) Notice: Subject to any disclaimer, the term of this patent is extended or adjusted under 35 U.S.C. 154(b) by 259 days.

(21) Appl. No.: 15/760,406

(22) PCT Filed: Sep. 15, 2016

(86) PCT No.: PCT/SE2016/050864
§ 371 (c)(1),
(2) Date: Mar. 15, 2018

(87) PCT Pub. No.: WO2017/048182
PCT Pub. Date: Mar. 23, 2017

(65) Prior Publication Data

US 2019/0058261 A1 Feb. 21, 2019

(30) Foreign Application Priority Data

Sep. 15, 2015 (SE) ..... 1551185

(51) Int. Cl.
*H01Q 21/08* (2006.01)
*H01Q 3/32* (2006.01)
(Continued)

(52) U.S. Cl.
CPC ..... *H01Q 21/08* (2013.01); *H01P 3/06* (2013.01); *H01P 5/026* (2013.01); *H01Q 1/246* (2013.01);
(Continued)

(58) Field of Classification Search
CPC ..... H01Q 1/246; H01Q 21/08; H01Q 21/26; H01Q 21/006; H01Q 15/14; H01Q 3/32; H01Q 21/0006; H01P 3/06; H01P 5/026
See application file for complete search history.

(56) References Cited

U.S. PATENT DOCUMENTS 5,801,600 A 9/1998 Butland et al.
6,683,582 B1 * 1/2004 Love ..... H01P 1/183 333/160
(Continued)

FOREIGN PATENT DOCUMENTS

CN 102714354 A 10/2012
EP 0575808 A1 12/1993
(Continued)

OTHER PUBLICATIONS

PCT/SE2016/050863, International Search Report, dated Dec. 16, 2016, Patent-och registreringsverket Box 5055 S-102 42 Stockholm, Sweden.
(Continued)

*Primary Examiner* — Dameon E Levi
*Assistant Examiner* — Jennifer F Hu
(74) *Attorney, Agent, or Firm* — The Jansson Firm; Pehr B. Jansson

(57) ABSTRACT

An antenna feeding network for a multi radiator antenna is provided. The antenna feeding network comprises at least one coaxial line. Each coaxial line comprises a central inner conductor and an elongated outer conductor surrounding the central inner conductor, wherein at least one of the outer
(Continued)

conductors of the coaxial lines is provided with an opening, wherein the antenna feeding network further comprises at least one nonconductive holding element configured to be placed in the opening. The holding element is configured to hold at least one of the inner conductors in position. The invention further relates to a multi radiator antenna comprising such an antenna feeding network, and to a method for providing an electrical connection in such an antenna feeding network.

27 Claims, 4 Drawing Sheets

(51) Int. Cl.

| | |
|---|---|
| ***H01Q 21/26*** | (2006.01) |
| ***H01Q 1/24*** | (2006.01) |
| ***H01P 5/02*** | (2006.01) |
| ***H01P 3/06*** | (2006.01) |
| ***H01Q 15/14*** | (2006.01) |
| ***H01Q 21/00*** | (2006.01) |
| ***H01R 9/05*** | (2006.01) |

(52) U.S. Cl.
CPC ..... *H01Q 3/32* (2013.01); *H01Q 15/14* (2013.01); *H01Q 21/0006* (2013.01); *H01Q 21/26* (2013.01); *H01R 9/0503* (2013.01); *H01R 2201/02* (2013.01)

(56) References Cited

U.S. PATENT DOCUMENTS

| | | | | |
|---|---|---|---|---|
| 7,619,580 | B2 * | 11/2009 | Lenart | H01P 3/06 343/830 |
| 8,576,137 | B2 * | 11/2013 | Jonsson | H01Q 3/32 343/835 |
| 2001/0048351 | A1 | 12/2001 | Love | |
| 2002/0135520 | A1 | 9/2002 | Teillet et al. | |
| 2002/0135527 | A1 | 9/2002 | Teillet et al. | |
| 2004/0203284 | A1 * | 10/2004 | Stolle | H01Q 21/29 439/578 |
| 2004/0263389 | A1 | 12/2004 | Haunberger et al. | |
| 2005/0134517 | A1 | 6/2005 | Gottl | |
| 2007/0205954 | A1 * | 9/2007 | Lenart | H01Q 9/16 343/850 |
| 2007/0241984 | A1 | 10/2007 | Schadler | |
| 2008/0139044 | A1 | 6/2008 | Hantsch et al. | |
| 2010/0001811 | A1 | 1/2010 | Haunberger et al. | |
| 2010/0007571 | A1 | 1/2010 | Riedel | |
| 2010/0201590 | A1 | 8/2010 | Girard et al. | |
| 2010/0201593 | A1 * | 8/2010 | Jonsson | H01Q 1/246 343/824 |
| 2010/0283710 | A1 | 11/2010 | Lutman et al. | |
| 2013/0088402 | A1 | 4/2013 | Lindmark et al. | |
| 2014/0035698 | A1 | 2/2014 | Schadler et al. | |
| 2014/0139387 | A1 | 5/2014 | Jones et al. | |
| 2015/0109183 | A1 | 4/2015 | Smith | |
| 2015/0180135 | A1 | 6/2015 | Jonsson et al. | |

FOREIGN PATENT DOCUMENTS

| | | | |
|---|---|---|---|
| KR | 20100117838 | A | 11/2010 |
| WO | WO8605325 | A1 | 9/1986 |
| WO | WO02067374 | A1 | 8/2002 |
| WO | WO2005060049 | A1 | 10/2005 |
| WO | WO2005101566 | A1 | 10/2005 |
| WO | WO2006006913 | A1 | 1/2006 |
| WO | WO2009041895 | | 4/2009 |
| WO | WO2009041896 | A1 | 4/2009 |
| WO | WO2012003506 | A2 | 1/2012 |
| WO | WO2012103821 | A2 | 8/2012 |
| WO | WO2014120062 | A1 | 8/2014 |
| WO | WO2017048181 | A1 | 3/2017 |
| WO | WO2017048182 | A1 | 3/2017 |

OTHER PUBLICATIONS

PCT/SE2016/050863, Written Opinion of the International Searching Authority, dated Dec. 16, 2016, Patent-och registreringsverket Box 5055 S-102 42 Stockholm, Sweden.
PCT/SE2017/050087, International Search Report, dated May 4, 2017, Patent-och registreringsverket Box 5055 S-10242 Stockholm, Sweden.
PCT/SE2017/050087, Written Opinion of the International Searching Authority, dated May 4, 2017, Patent-och registreringsverket Box 5055 S-10242 Stockholm, Sweden.
PCT/SE2017/050088, International Search Report, dated Apr. 28, 2017, Patent-och registreringsverket Box 5055 S-10242 Stockholm, Sweden.
PCT/SE2017/050088, Written Opinion of the International Searching Authority, dated Apr. 28, 2017, Patent-och registreringsverket Box 5055 S-10242 Stockholm, Sweden.
PCT/SE2017/050618, International Search Report, dated Aug. 30, 2017, Patent-och registreringsverket Box 5055 S-10242 Stockholm, Sweden.
PCT/SE2017/050618, Written Opinion of the International Searching Authority, dated Aug. 30, 2017, Patent-och registreringsverket Box 5055 S-10242 Stockholm, Sweden.
PCT/SE2016/050864, International Search Report, dated Nov. 30, 2016, Patent-och registreringsverket Box 5055 S-10242 Stockholm, Sweden.
PCT/SE2016/050864, Written Opinion of the International Searching Authority, dated Nov. 30, 2016, Patent-och registreringsverket Box 5055 S-10242 Stockholm, Sweden.
PCT/SE2016/050867, International Search Report, dated Dec. 14, 2016, Patent-och registreringsverket Box 5055 S-10242 Stockholm, Sweden.
PCT/SE2016/050867, Written Opinion of the International Searching Authority, dated Dec. 14, 2016, Patent-och registreringsverket Box 5055 S-10242 Stockholm, Sweden.
PCT/SE2016/050868, International Search Report, dated Dec. 16, 2016, Patent-och registreringsverket Box 5055 S-10242 Stockholm, Sweden.
PCT/SE2016/050868, Written Opinion of the International Searching Authority, dated Dec. 16, 2016, Patent-och registreringsverket Box 5055 S-10242 Stockholm, Sweden.
PCT/SE2016/050864, Supplemental European Search Report, dated Apr. 2, 2019, European Patent Office, 80298 Munich, Germany.

* cited by examiner

ANTENNA FEEDING NETWORK COMPRISING AT LEAST ONE HOLDING ELEMENT

TECHNICAL FIELD

The invention relates to the field of antenna feeding networks for multi-radiator antennas, which feeding network comprises at least two coaxial lines.

BACKGROUND OF THE INVENTION

Multi-radiator antennas are frequently used in for example cellular networks. Such multi-radiator antennas comprise a number of radiating antenna elements for example in the form of dipoles for sending or receiving signals, an antenna feeding network and an electrically conductive reflector. The antenna feeding network distributes the signal from a common coaxial connector to the radiators when the antenna is transmitting and combines the signals from the radiators and feeds them to the coaxial connector when receiving. A possible implementation of such a feeding network is shown in FIG. 1.

In such a network, if the splitters/combiners consist of just one junction between 3 different 50 ohm lines, impedance match would not be maintained, and the impedance seen from each port would be 25 ohm instead of 50 ohm. Therefore the splitter/combiner usually also includes an impedance transformation circuit which maintains 50 ohm impedance at all ports.

A person skilled in the art would recognize that the feeding is fully reciprocal in the sense that transmission and reception can be treated in the same way, and to simply the description of this invention only the transmission case is described below.

The antenna feeding network may comprise a plurality of parallel substantially air filled coaxial lines, each coaxial line comprising a central inner conductor at least partly surrounded by an outer conductor with insulating air in between. The coaxial lines and the reflector may be formed integrally with each other. The splitting may be done via crossover connections between inner conductors of adjacent coaxial lines. In order to preserve the characteristic impedance, the lines connecting to the crossover element include impedance matching structures.

In order to achieve the above described distribution of signals in an antenna feeding network having such coaxial lines, connections to/from and between the inner conductors need to be provided. This usually requires making openings in the outer conductor(s) in order to connect one or more connecting means to or between the inner conductor(s). These openings must be of such size that there is no risk for short circuit or arcing between the connecting means and the outer conductor. It is however desirable to avoid or minimize openings in general in the outer conductors since openings, and large openings in particular, may result in reduced mechanical stability of the antenna, and may also influence the impedance properties negatively in the antenna feeding network, and may also result in unwanted radiation from the feeding network. Such unwanted radiation may reduce the antenna performance in terms of e.g. back- or sidelobe suppression. In antennas having two cross-polarized channels, it may also reduce cross-polarisation isolation and also isolation between the two channels. All those antenna parameters may be important to the performance of e.g. a cellular network in terms of e.g. interference and fading reduction. Openings in the outer conductor on the front side of the reflector may degrade antenna performance more than openings in the back side of the reflector. Consequently, openings on the front side of the reflector are usually avoided despite the possible improvements in terms of design flexibility which may be achieved using such openings.

SUMMARY OF THE INVENTION

An object of the present invention is to overcome at least some of the disadvantages of the prior art described above. A further object is to provide an antenna feeding network which is easy to assemble.

According to a first aspect of the invention, an antenna feeding network for a multi radiator antenna is provided. The antenna feeding network comprises at least one or at least two coaxial lines. Each coaxial line comprises a central inner conductor and an elongated outer conductor surrounding the central inner conductor, wherein at least one of the outer conductors of the coaxial line(s) is provided with an opening, wherein the antenna feeding network further comprises at least one non-conductive holding element configured to be placed in the opening, wherein the non-conducting holding element may be provided with at least one passage adapted to receive connecting means being electrically connectable to at least one of the inner conductors, and wherein the non-conducting holding element is configured to position or hold said at least one of the inner conductors relative to the at least one of the outer conductors.

Put differently, the holding element of the antenna feeding network may be provided with at least one opening, passage or through hole for receiving electrical connecting means therein to connect with at least one of the inner conductors. In other words, the at least one opening, passage or through hole is adapted to allow insertion of the connecting means therein in such a manner that it is connected or connectable to at least one of the inner conductors. It is understood that the opening, passage or through hole provides a path for the connecting means which is insulated from the outer conductor when the element is positioned in the opening.

According to a second aspect of the invention, a multi radiator antenna is provided. The antenna comprises an electrically conductive reflector, at least one radiating element arranged on the front side of the reflector and an antenna feeding network according to the first aspect of the invention. The radiating elements are connected to the antenna feeding network. The opening in the at least one outer conductor of the coaxial lines may be located on either the front side or the back side of the reflector.

According to a third aspect of the invention, a method for providing an electrical connection in an antenna feeding network for a multi radiator antenna is provided. The antenna feeding network comprises at least one or at least two coaxial lines, wherein each coaxial line comprises a central inner conductor and an elongated outer conductor surrounding the central inner conductor. The method comprises providing at least one of the outer conductors of said coaxial line(s) with an opening, providing at least one non-conductive holding element in the opening, which non-conductive holding element is provided with a through passage adapted to provide access to at least one of said inner conductors, which holding element is configured to hold the at least one of the inner conductors in position, inserting connecting means in said passage and connecting said connecting means electrically to the at least one of said inner conductors.

The invention is based on the insight that smaller openings may be used without risking arcing or short circuit by providing insulating or dielectric holding elements in said openings through which connecting means to inner conductor(s) may be provided. The invention is further based on the insight that such a holding element may be configured to hold the inner conductor(s) in position for easier and more efficient connection to the inner conductor(s). The invention is further based on the insight that the performance of the antenna feeding network is dependent on the position of the inner conductors relative to the outer conductors, both laterally and longitudinally, and on the insight that a simplified antenna feeding network with fewer parts may be achieved by providing a holding element configured to hold the inner conductor(s) in the desired position rather than using separate components such as dielectric support means to position the inner conductor(s). The invention is further based on the insight that using such a holding element, if made in a dielectric material, may be configured to improve the impedance matching of the antenna arrangement.

It is understood that coaxial line refers to an arrangement comprising an inner conductor and an outer conductor with insulating or dielectric material or gas there between, where the outer conductor is coaxial with the inner conductor in the sense that it completely or substantially surrounds the inner conductor. Thus, the outer conductor does not necessarily have to surround the inner conductor completely, but may be provided with openings or slots, which slots may even extend along the full length of the outer conductor.

The at least one or at least two coaxial lines may be substantially air filled, each being provided with air between the inner and outer conductors. The air between the inner and outer conductors thus replaces the dielectric often found in coaxial cables. It is understood that the term substantially air filled is used to describe that the coaxial line is provided not solely with air inside the outer conductor, but also with at least one holding element which occupies part of the space inside the outer conductor which would otherwise be filled with air. In embodiments described below, the antenna feeding network may be provided with further components inside the outer conductor such as support elements and dielectric elements which also occupies part of the space inside the outer conductor which would otherwise be filled with air. The coaxial line is thus substantially, but not completely, air filled in these embodiments.

In embodiments, the holding element is configured to hold at least one of the inner conductors in position. The holding element may be configured to hold the at least one of the inner conductors in position in the longitudinal and/or sideways and/or lateral direction of the antenna feeding network In embodiments, the holding element may further be configured to hold a connecting means in position, which connecting means is configured to connect with the inner conductor. The holding element may be configured to hold the connecting means in position in the longitudinal and/or sideways and/or lateral direction of the antenna feeding network.

In embodiments, where the antenna feeding network comprises at least two coaxial lines, at least two of the outer conductors of the coaxial lines are each provided with an opening, wherein the holding element is configured to be placed in the openings and engage and hold the inner conductors in the at least two outer conductors in position. In other words, the holding element fixates both the inner conductors. This is advantageous since it allows the two inner conductors to be conveniently interconnected. The holding element may be configured to hold the inner conductors in position in the longitudinal and/or sideways and/or lateral direction of the antenna feeding network. The at least two coaxial lines may be arranged in parallel. The at least two coaxial lines may be arranged adjacent each other.

The at least two outer conductors provided with an opening may be neighbouring outer conductors, and the openings may together form a combined, continuous or single opening extending between the at least two outer conductors. The holding element may be configured to be placed in the combined, continuous or single opening to engage and hold the inner conductors arranged in the at least two neighbouring outer conductors in position.

The antenna feeding network may furthermore comprise connecting means in the form of a connector device configured to electrically interconnect the two inner conductors. The holding element may further be configured to hold the connector device in position. The passage of the holding element may be adapted to receive the connector device at least partly therein. The connector device may be configured to electrically interconnect the two inner conductors galvanically or indirectly, i.e. capacitively, inductively or a combination thereof.

In embodiments, the holding element is adapted to the shape of the opening so that the holding element fits snugly into the opening.

In embodiments, the holding element comprises a support portion arranged to support the holding element against a portion of at least one of the outer conductors, for example against a side wall portion separating two neighbouring coaxial lines.

In embodiments, the holding element further comprises at least one U-shaped portion configured to at least partly surround and engage with an inner conductor such that the inner conductor is held in position.

In embodiments, the inner conductor is provided with a recess or groove, for example a circumferential groove, wherein the at least one U-shaped portion is configured to engage with said groove or recess in said inner conductor, such that the inner conductor is held in place in a longitudinal direction.

In embodiments, the inner conductor is provided with a groove or recess, for example a circumferential groove, configured to co-operate with connecting means in such a manner that the connecting means, when positioned into the outer conductor in the opening made in the outer conductor, positions the inner conductor relative to the outer conductor.

In embodiments, the holding element may co-operate or comprise a retaining mechanism configured to releasably withhold the holding element in the opening. The retaining mechanism may comprise at least one holding portion of the holding element adapted to engage with at least one complementary holding portion of the outer conductor provided with an opening. The holding portion may be wedge-shaped and be configured to engage with the complementary holding portion in the form of the edge of the opening. The wedge-shaped holding portion is directed so that the holding element can be pushed into the opening but prevent the holding element from accidentally leaving the opening.

The holding element may comprise at least one gripping portion extending outside, beyond or above the outer conductor or conductors when the holding element is arranged in the opening. This is advantageous since it allows the holding element to be conveniently gripped or grasped when it is to be removed from the opening. The gripping portion(s) is/are advantageously embodied as vertically protruding bar-shaped portions of the holding element.

The retaining mechanism may further comprise at least one laterally protruding nose portion of the holding element configured to abut against an outer surface portion of the outer conductor provided with an opening when the holding element is arranged in the opening. This is advantageous since it prevents the holding element from being pushed too deep into the opening.

In embodiments, at least one, or each, coaxial line of said at least one coaxial line is provided with at least one support element configured to support the central inner conductor, the support element being located between the outer and inner conductors.

In embodiments, at least one, or each, coaxial line of said at least one coaxial line is furthermore provided with at least one dielectric element to at least partially fill the cavity between the inner and outer conductors. Such dielectric element(s) is/are preferably slidably movable inside the outer conductor(s) to co-operate with the coaxial line(s) to provide a phase shifting arrangement. The phase shift is achieved by moving the dielectric element that is located between the inner conductor and the outer conductor of the coaxial line. It is a known physical property that introducing a material with higher permittivity than air in a transmission line will reduce the phase velocity of a wave propagating along that transmission line. This can also be perceived as delaying the signal or introducing a phase lag compared to a coaxial line that has no dielectric material between the inner and outer conductors. If the dielectric element is moved in such a way that the outer conductor will be more filled with dielectric material, the phase shift will increase. The at least one dielectric element may have a U-shaped profile such as to partly surround the inner conductor in order to at least partly fill out the cavity between the inner and outer conductors.

In embodiments, two of said at least two coaxial lines form a splitter/combiner. When operating as a splitter, the inner conductor of a first coaxial line is part of the incoming line, and the two ends of the inner conductor of the second coaxial line are the two outputs of the splitter. Thus, the second coaxial line forms two outgoing coaxial lines. In such an embodiment, the dielectric element may be arranged in the second coaxial line in such a way that by moving the dielectric part different amount of dielectric material is present in the respective outgoing coaxial lines. Such an arrangement allows the differential phase of the outputs of a splitter to be varied by adjusting the position of the dielectric part within the splitter. A reciprocal functionality will be obtained when the coaxial line functions as a combiner. Such splitters/combiners having variable differential phase shifting capability are advantageously used in an antennas having radiators positioned in a vertical column, to adjust the electrical antenna tilt angle by adjusting the relative phases of the signals feeding the radiators.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
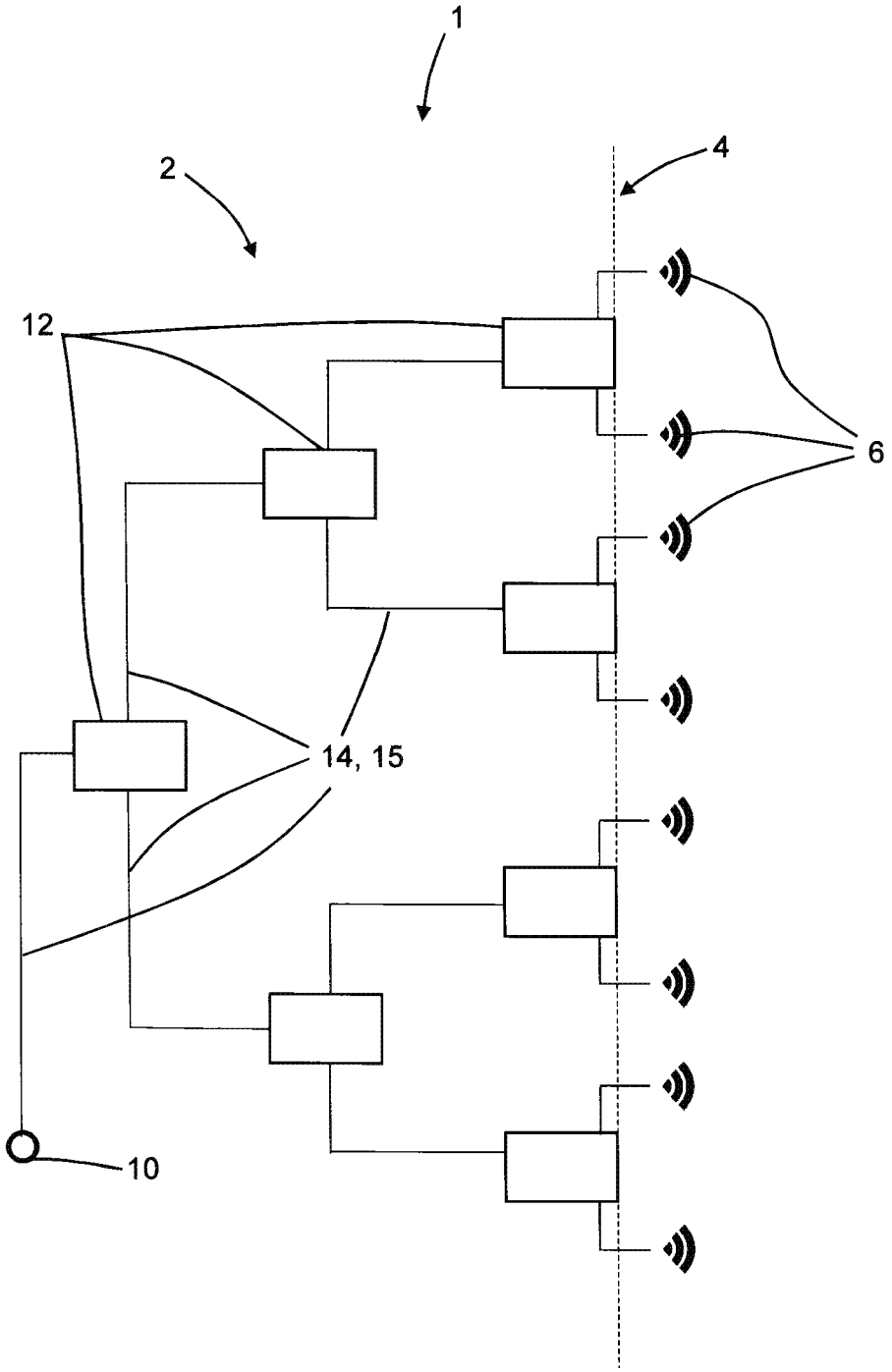
FIG. 1 schematically illustrates an antenna feeding network.

FIG. 1 schematically illustrates an antenna arrangement 1 comprising an antenna feeding network 2, an electrically conductive reflector 4, which is shown schematically in FIG. 1, and a plurality of radiating elements 6. The radiating elements 6 may be dipoles.

The antenna feeding network 2 connects a coaxial connector 10 to the plurality of radiating elements 6 via a plurality of lines 14, 15, which may be coaxial lines, which are schematically illustrated in FIG. 1. The signal to/from the connector 10 is split/combined using, in this example, three stages of splitters/combiners 12.

Figure 2:
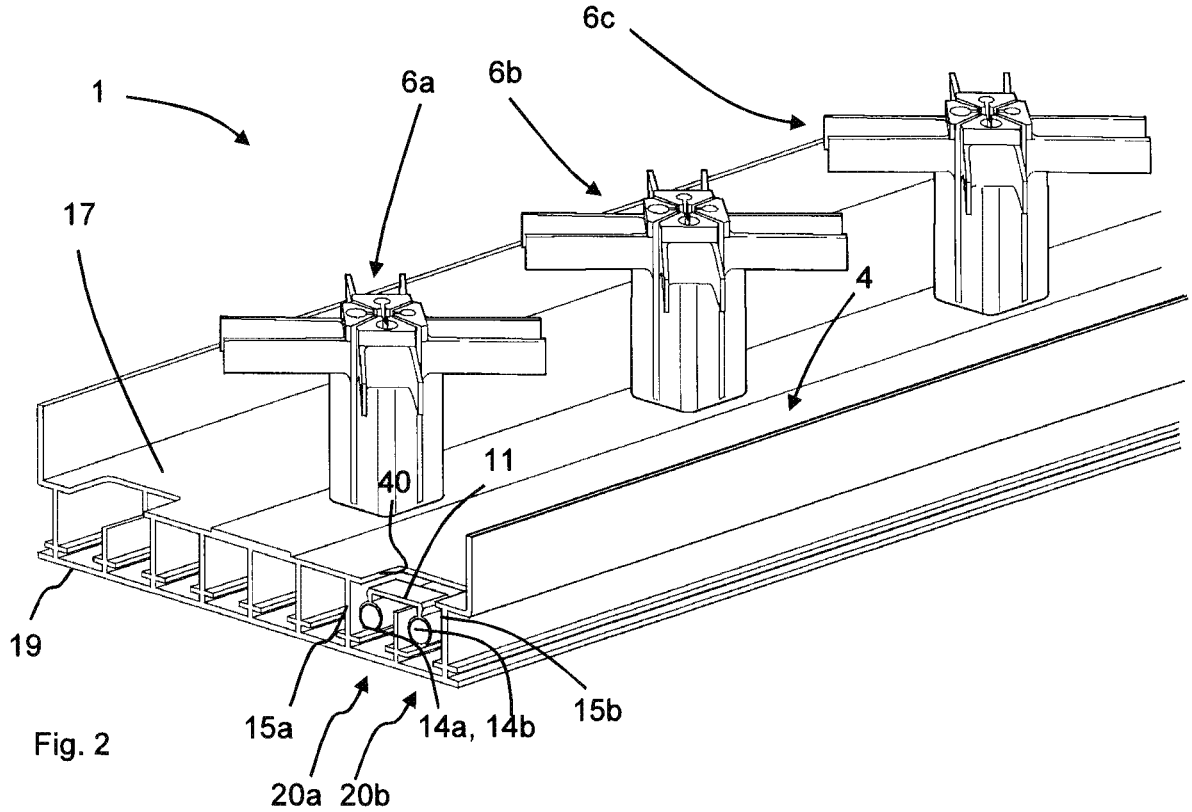
FIG. 2 schematically illustrates an embodiment of a multi-radiator antenna according to the second aspect of the invention.

Turning now to FIG. 2, which illustrates a multi-radiator antenna 1 in a perspective view, the antenna 1 comprises the electrically conductive reflector 4 and radiating elements 6*a-c*.

The electrically conductive reflector 4 comprises a front side 17, where the radiating elements 6*a-c* are mounted and a back side 19.

FIG. 2 shows a first coaxial line 20*a* which comprises a first central inner conductor 14*a*, an elongated outer conductor 15*a* forming a cavity or compartment around the central inner conductor, and a corresponding second coaxial line 20*b* having a second inner conductor 14*b* and an elongated outer conductor 15*b*. The outer conductors 15*a*, 15*b* have square cross sections and are formed integrally and in parallel to form a self-supporting structure. The wall which separates the coaxial lines 20*a*, 20*b* constitute vertical parts of the outer conductors 15*a*, 15*b* of both lines. The first and second outer conductors 15*a*, 15*b* are formed integrally with the reflector 4 in the sense that the upper and lower walls of the outer conductors are formed by the front side 17 and the back side 19 of the reflector, respectively.

Although the first and second inner conductors 14*a*, 14*b* are illustrated as neighbouring inner conductors they may actually be further apart thus having one or more coaxial lines or empty outer conductors in between.

In FIG. 2 not all longitudinal channels or outer conductors are illustrated with inner conductors, it is however clear that they may comprise such inner conductors.

The front side 17 of the reflector may comprise at least one opening 40 for the installation of the connector device 11. The opening 40 extends over the two neighbouring coaxial lines 20*a*, 20*b* so that the connector device 11 can engage the first and the second inner conductor 14*a*, 14*b*. The connector device 11 is configured to electrically interconnect the two inner conductors 14*a-b*. The opening 40 is larger than the connector device 11 to avoid arcing or short-circuit between the outer conductors and the connector device.

Although the invention is illustrated with two neighbouring inner conductors 14*a*, 14*b* it falls within the scope to have an opening (not shown) that extends across more than two coaxial lines 20*a*, 20*b* and to provide a connector device 11 than can bridge two or even more inner conductors. Such a connector device (not shown) may thus be designed so that it extends over a plurality of coaxial lines between two inner conductors or over empty cavities or compartments. Such a connector device (not shown) may also be used to connect three or more inner conductors.

Figure 3:
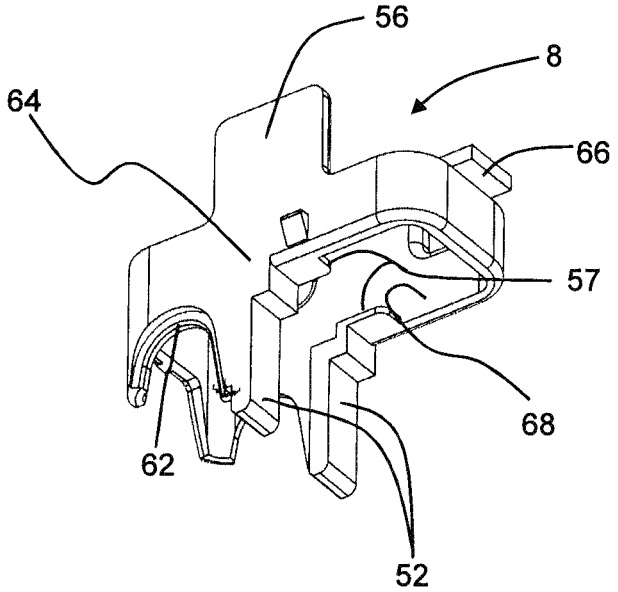
FIG. 3 schematically illustrates a holding element of an embodiment of an antenna feeding according to the first aspect of the invention.
Figure 4:
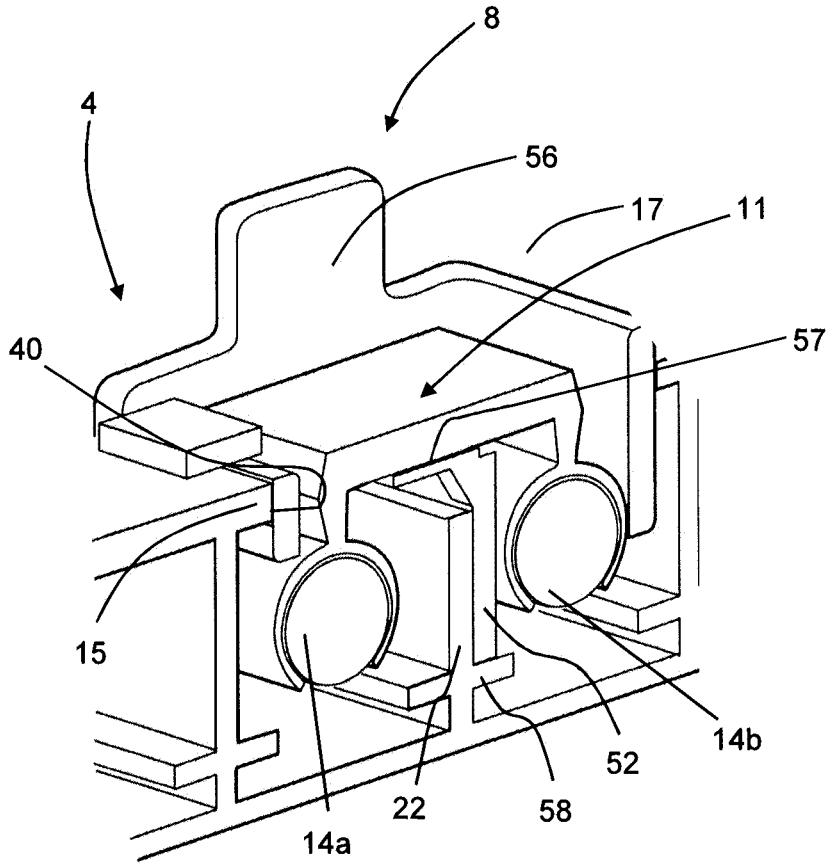
FIG. 4 schematically illustrates a perspective view of a cross section cut transversally to coaxial lines through the holding element of an embodiment of an antenna feeding according to the first aspect of the invention.

Referring now to FIGS. 3 and 4, a holding element 8 is illustrated. FIG. 3 illustrates a perspective view of the holding element 8 of an embodiment of an antenna feeding network according to the first aspect of the invention. The holding element is made of plastic, but may in other embodiments be made from other electrically insulating materials. The holding element 8 comprises a body portion 64 having an opening or passage 68. The body portion 64 is adapted to have a shape that corresponds at least more or less to the shape of the opening 40 (c.f. FIG. 4). The holding element 8 further comprises two downwardly extending support portions 52 as shown in FIG. 3, the support extension portions 52 being configured to support the holding element against a protrusion or ridge 58 extending horizontally from the vertical separating wall portion 22, which is cut down from its original height in the area of the opening, as shown in FIG. 4. The support portions 52 may further comprise a step 57 as illustrated in FIG. 3. The step 57 is used for providing support to the connector device 11, as illustrated in FIG. 4.

The connector device 11 can be installed on the two inner conductors 14 after the holding element 8 is put in place. The connector device 11 is inserted and guided through the opening or passage 68 when the two or more inner conductors are engaged. In embodiments, the connector device 11 may engage with a groove in the inner conductor 14 in order to position the inner conductor relative the outer conductor in a longitudinal direction.

Referring to FIG. 3, the holding element 8 may further comprise gripping portions 56. The gripping portions 56 are embodied as protrusions that extend over the top surface 17 of the electrically conductive reflector 4.

Figure 6:
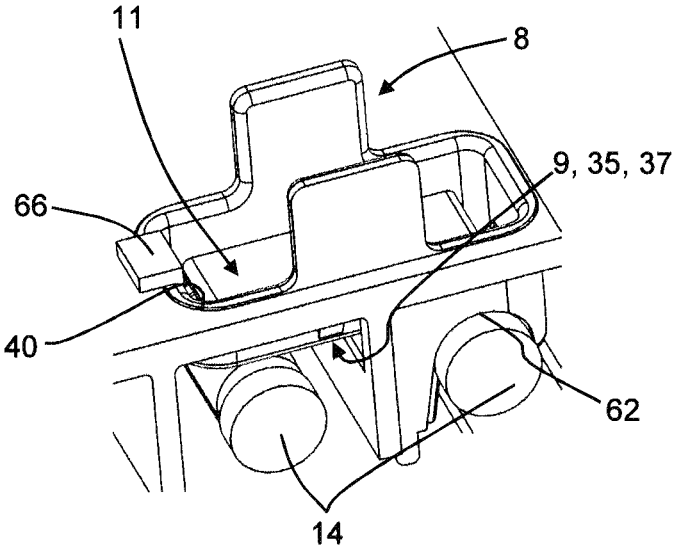
FIG. 6 schematically illustrates a perspective view of a holding element of an embodiment of an antenna feeding according to the first aspect of the invention, where the holding element is installed in an opening of the outer conductors.

FIG. 6 illustrates further that the holding element 8 comprises a pair of gripping portions 56 arranged opposite one another on the long side of the body portion 64.

The holding element 8 may further comprise a pair of U-shaped conductor engaging portions 62 that are configured to at least partly surround and engage at least one of the inner conductors 14. In this embodiment, the pair of conductor engaging portions 62 are arranged on a long side of the body portion 64. In embodiments, the engaging portions 62 may engage with a groove made in the inner conductor (not shown) which allows the inner conductor to be positioned in a longitudinal direction. The holding element 8 further comprises a laterally protruding nose portion 66 that is configured to rest on the top side 17 of the reflector.

Figure 5:
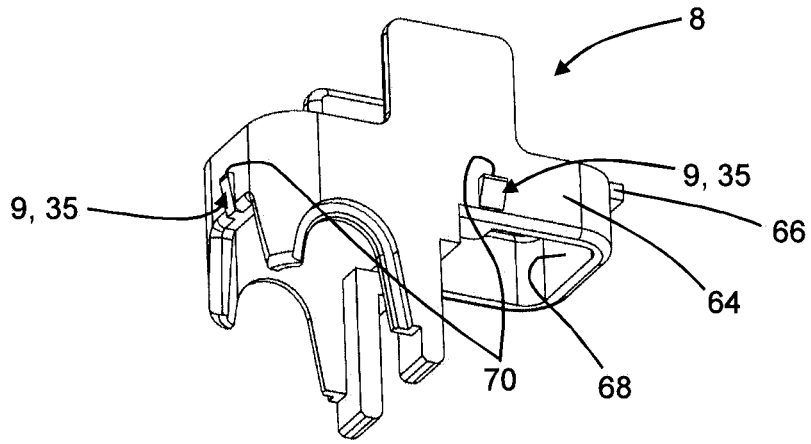
FIG. 5 schematically illustrates another view of a holding element of an embodiment of an antenna feeding according to the first aspect of the invention.

The holding element 8 may further comprise a retaining mechanism 9 of a snap-on type, which is described further on referring to FIGS. 5 and 6. The retaining mechanism 9 comprises snap on holding portions 35 that are arranged on the body portion 64 of the holding element 8 on the outer side of the body portion 64 which are thus directed away from the opening or passage 68. The illustrated embodiment of the holding element 8 comprises three snap on portions 35, one on each longitudinal side of the body portion 64 and one on the front side of the body portion 64 on the opposite side of the nose portion 66. The body portion 64 may however in other embodiments comprise another number of snap on portions 35.

The snap on portions are formed as downwardly tapering wedges. An end surface or step 70 of the snap on portions, as shown in FIG. 5 is configured to engage with a complementary snap on portion 37 embodied in the form of the lower edge of the opening 40, as illustrated in FIG. 6. The tapering part of the snap on portion 35 is used to allow the holding element 8 to be smoothly pushed into the opening 40. Since the holding element 8 is made of a slightly flexible material such as plastic, it is allowed to bend a bit so that the end surfaces 70 can engage the lower edge of the opening 40.

FIG. 6 further illustrates how the conductor engaging portions 62 engages at least one of the inner conductors 14.

Figure 7:
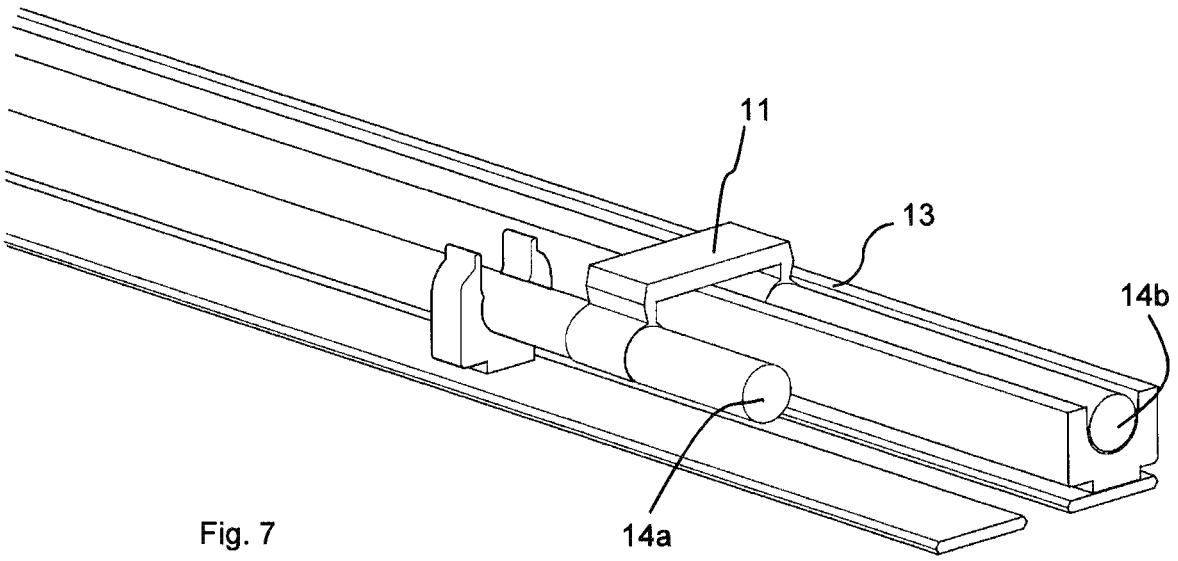
FIG. 7 schematically illustrates a perspective view of parts of an embodiment of an antenna feeding network according to the first aspect of the invention.

FIG. 7 shows a view of parts of an embodiment of the antenna feeding network shown without outer conductors and holding element. The connector device 11 engages the first and second inner conductors 14*a*, 14*b*. The connector device 11 and the inner conductors 14*a*, 14*b* together form a splitter/combiner. When operating as a splitter, the inner conductor 14*a* is part of the incoming line, and the two ends of the inner conductor 14*b* are the two outputs of the splitter. The U-shaped dielectric element 13 can be moved along the inner conductor 14*b*, which, together with an outer conductor (not shown), forms first and second coaxial output lines on opposite sides of the connector device 11. The dielectric element thus has various positions along those coaxial output lines.

We first consider the case when the dielectric element 13 is placed in a central position, equally filling the first and second output coaxial lines. When a signal is entered at the input coaxial line 14*a*, it will be divided between the first output coaxial line and the second output coaxial line, and the signals coming from the two output coaxial lines will be equal in phase. If the dielectric element 13 is moved in such a way that the first output coaxial line will be more filled with dielectric material than the second output coaxial line, the phase shift from the input to the first output will increase. At the same time the second output coaxial line will be less filled with dielectric, and the phase shift from the input to the second output will decrease. Hence, the phase at the first output will lag the phase at the second output. If the dielectric element is moved in the opposite direction, the phase of the first output will lead the phase of the second output. The splitter/combiner may thus be described as a differential phase shifter.

The description above and the appended drawings are to be considered as non-limiting examples of the invention. The person skilled in the art realizes that several changes and modifications may be made within the scope of the invention. For example, the number of coaxial lines may be varied, the number of radiators or dipoles may be varied, and the holding element may be fixed in the opening by another type of retaining mechanism. Further, the holding element may comprise two pairs of conductor engaging portions each pair being assigned to one of the plurality of inner conductors. Furthermore, the reflector does not necessarily need to be formed integrally with the coaxial lines, but may on the contrary be a separate element. The scope of protection is determined by the appended patent claims.

The invention claimed is:

1. An antenna, feeding network for a multi radiator antenna, the antenna feeding network comprising at least two coaxial lines, wherein each coaxial line comprises a central inner conductor and an elongated outer conductor surrounding the central inner conductor, wherein at least two of the outer conductors of said coaxial lines each are provided with an opening, wherein said at least two outer conductors provided with openings are neighbouring outer conductors, wherein the openings together form a combined opening extending between said at least two outer conductors, wherein said antenna feeding network further comprises at least one non-conductive holding element configured to be placed in said combined opening, further comprising connecting means in the form of a connector device, wherein said non-conductive holding element comprises at least one passage adapted to receive said connector device, wherein said connector device is configured to electrically interconnect the two inner conductors, and wherein said holding element is configured to hold the connector device in position and to engage and hold the inner conductors in said at least two outer conductors in position.

2. The antenna feeding network according to claim 1, wherein said passage of the holding element is adapted to receive said connector device therein.

3. The antenna feeding network according to claim 1, wherein the holding element is adapted to the shape of the opening so that the holding element snugly fits into the opening.

4. The antenna feeding network according to claim 1, wherein the holding element comprises a support portion arranged to support the holding element against a portion of at least one of said outer conductors.

5. The antenna feeding network according to claim 1, wherein said holding element comprises at least one U-shaped portion configured to at least partly surround and engage with at least one of said inner conductors.

6. The antenna feeding network according to claim 5, wherein said inner conductor is provided with a groove or recess, and wherein said at least one U-shaped portion is configured to engage with said groove or recess such that the inner conductor is held in position in the longitudinal direction.

7. The antenna feeding network according to claim 1, wherein said inner conductor is provided with a groove or recess configured to co-operate with said connecting means to position the inner conductor relative to the outer conductor.

8. The antenna feeding network according to claim 1, wherein the holding element is placed and withheld in the opening by a retaining mechanism, wherein the retaining mechanism comprises at least one holding portion on the holding element adapted to engage with at least one complementary holding portion of the outer conductor provided with the opening.

9. The antenna feeding network according to claim 8, wherein the holding portion is wedge-shaped and is configured to engage with the complementary holding portion in the form of the edge of the opening.

10. The antenna feeding network according to claim 8, wherein said retaining mechanism comprises a laterally protruding nose portion of the holding element configured to abut against an outer surface portion of the outer conductor provided with the opening when the holding element is arranged in the opening.

11. The antenna feeding network according to claim 1, wherein said holding element comprises at least one gripping portion extending outside said outer conductor or conductors when the holding element is arranged in the opening.

12. The antenna feeding network according to claim 1, wherein the coaxial lines are substantially air filled.

13. The antenna feeding network according to claim 1, wherein said at least one holding element is made from a dielectric material, and wherein said at least one holding element is configured to provide an impedance matching structure.

14. A multi radiator antenna comprising an electrically conductive reflector, at least one radiating element arranged on a front side of said reflector and an antenna feeding network, said radiating elements being connected to said antenna feeding network, the antenna feeding network comprising at least two coaxial lines, wherein each coaxial line comprises a central inner conductor and an elongated outer conductor surrounding the central inner conductor, wherein at least two of the outer conductors of said coaxial lines each are provided with an opening, wherein said at least two outer conductors provided with openings are neighbouring outer conductors, wherein the openings together form a combined opening extending between said at least two outer conductors, wherein said antenna feeding network further comprises at least one non-conductive holding element configured to be placed in said combined opening, further comprising connecting means in the form of a connector device, wherein said non-conductive holding element comprises at least one passage adapted to receive said connector device, wherein said connector is configured to electrically interconnect the two inner conductors, and wherein said holding element is configured to hold the connector device in position and to engage and hold the inner conductors in said at least two outer conductors in position.

15. The multi radiator antenna according to claim 14, wherein said opening is provided through said front side of said reflector.

16. The multi radiator antenna of claim 14, wherein said passage of the holding element is adapted to receive said connector device therein.

17. The multi radiator antenna of claim 14, wherein the holding element is adapted to the shape of the opening so that the holding element snugly fits into the opening.

18. The multi radiator antenna of claim 14, wherein the holding element comprises a support portion arranged to support the holding element against a portion of at least one of said outer conductors.

19. The multi radiator antenna of claim 14, wherein said holding element comprises at least one U-shaped portion configured to at least partly surround and engage with at least one of said inner conductors.

20. The multi radiator antenna of claim 19, wherein said inner conductor is provided with a groove or recess, and wherein said at least one U-shaped portion is configured to engage with said groove or recess such that the inner conductor is held in position in the longitudinal direction.

21. The multi radiator antenna of claim 14, wherein said inner conductor is provided with a groove or recess configured to co-operate with said connecting means to position the inner conductor relative to the outer conductor.

22. The multi radiator antenna of claim 14, wherein the holding element is placed and withheld in the opening by a retaining mechanism, wherein the retaining mechanism comprises at least one holding portion on the holding element adapted to engage with at least one complementary holding portion of the outer conductor provided with the opening.

23. The multi radiator antenna of claim 22, wherein the holding portion is wedge-shaped and is configured to engage with the complementary holding portion in the form of the edge of the opening.

24. The multi radiator antenna of claim 22, wherein said retaining mechanism comprises a laterally protruding nose portion of the holding element configured to abut against an outer surface portion of the outer conductor provided with the opening when the holding element is arranged in the opening.

25. The multi radiator antenna of claim 14, wherein the coaxial lines are substantially air filled.

26. The multi radiator antenna of claim 14, wherein said at least one holding element is made from a dielectric material, and wherein said at least one holding element is configured to provide an impedance matching structure.

27. A method for providing an electrical connection in an antenna feeding network for a multi radiator antenna, said antenna feeding network comprising at least two coaxial lines, wherein each coaxial line comprises a central inner conductor and an elongated outer conductor surrounding the central inner conductor, said method comprising:

providing at least two neighbouring outer conductors of said at least two coaxial lines with openings to form a combined opening extending between said at least two outer conductors;

providing at least one non-conductive holding element in the openings, wherein said non-conductive holding element is provided with a through passage adapted to provide access to at least one of said inner conductors, and wherein said holding element is configured to hold at least one of the inner conductors in position; and inserting connecting means in the form of a connector device in said passage and connecting said connector device electrically to the at least two inner conductors.

* * * * *